US006447335B1

(12) United States Patent
Ko

(10) Patent No.: US 6,447,335 B1
(45) Date of Patent: Sep. 10, 2002

(54) CABLE END CONNECTOR

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/906,878

(22) Filed: Jul. 16, 2001

(51) Int. Cl.[7] ..... H01R 9/05
(52) U.S. Cl. ..... 439/585; 439/582
(58) Field of Search ..... 439/585, 578–584

(56) References Cited

U.S. PATENT DOCUMENTS 5,061,206 A * 10/1991 Kawanami et al. ..... 439/585
5,263,877 A * 11/1993 Mitani ..... 439/585
5,569,049 A * 10/1996 Tatebe et al. ..... 439/585
5,772,470 A * 6/1998 Togashi ..... 439/582

* cited by examiner

*Primary Examiner*—Gary P. Paumen
(74) *Attorney, Agent, or Firm*—Wei Te Chung

(57) ABSTRACT

A cable end connector includes a dielectric housing (10), a terminal (30) received in the housing, a shell (50) shielding the housing, and a cover (60) attached to the shell for holding a coaxial cable (70) therein. The housing includes a tubular portion (20) and a base portion (40) engaged with the tubular portion. The shell has a trunk portion (51) and an inner periphery of the trunk portion interferentially engages with the tubular portion. The trunk portion has a pair of converging free portions (516) in a upper portion thereof and a pair of arms (513) rearwardly extending from a lower portion thereof, a shoulder (517) formed on each arm has a determined distance to the corresponding free portion. The cover attaches to the shoulders to hold a coaxial cable therein and interferes against the free portions.

1 Claim, 9 Drawing Sheets

CABLE END CONNECTOR

CROSS-REFERENCE TO RELATED APPLICATIONS

Reference is made to the copending U.S. Design Patent Application with an Ser. No. 145,170 titled "Cable End Connector with Low Profile after Assembly" filed on Jul. 16, 2001, by the same inventor and assigned to the same assignee of the present application.

FIELD OF THE INVENTION

The present invention relates to a cable end connector, and more particularly to a cable end connector for providing a reliable connection with a mating connector.

BACKGROUND OF THE INVENTION

Cable end connectors are often used for transmitting Radio-frequency (RF) signals. The cable end connector normally has a terminal received in a housing thereof to mate with a complementary plug. Such a conventional cable end connector is, for example, disclosed in U.S. Pat. No. 5,263,877. The cable end connector includes a dielectric member holding a central terminal within an outer conductive shell. The central terminal has a U-shaped connection portion for connecting with a coaxial cable and a coupling portion for mating with a complementary plug. As disclosed in this patent, in assembly, an upper side wall of the dielectric member and a holder portion of the outer shell are bent substantially at a right-angle to hold the connection portion of the terminal and an inner conductor of the coaxial cable within the dielectric member and to crimp the coaxial cable braiding to the connector outer shell. A projection of the holder portion crimps the dielectric member and a pair of wing portions are bent into a rectangular cross section formation, thereby connecting the shell with the dielectric member.

However, this cable end connector assembled with the coaxial cable exhibits a high profile such that a restive large space will be occupied. The present inventor has designed a connector to overcome the above disadvantage. Referring to FIGS. 8 and 9, the cable end connector comprises a dielectric housing 10' having a through hole 21' at the center, a terminal 30'received in the housing 10', a shell 50' enclosing the housing 10', and a cover 60'. The shell 50' includes a trunk portion 51' for meeting with a mating connector (not shown) and a planar portion 53'. A pair of arms 513' rearwardly extend from a lower portion of the trunk portion 51' and a pair of converging free portions 516' are defined in an upper portion of the trunk portion 51'. The cover 60' parks on and clips the arms 513' firmly. The cover 60' includes a body portion 61"which does not interfere with the free portions 516'.

However, since the body portion 61' of the cover 60' does not interfere with the free portions 516', when a mating connector mates/unmates with the cable end connector, the converging free portions 516' will move away from each other whereby an undue force will be encountered during mating/unmating with the mating connector. For example, when a mating connector having a pin at the center mates with the cable end connector, the pin of the mating connector may not align with the hole 21' of the cable end connector because the converging free portions 516' move away from each other, and is blocked by the other portion nearby the hole 21' of the cable end connector to prevent the mating connector from mating.

Hence, an improved cable end connector providing a reliable connection with a mating connector is required to overcome the disadvantages of the prior art.

BRIEF SUMMARY OF THE INVENTION

A main object of the present invention is to provide a cable end connector providing a reliable connection with a mating connector.

To fulfill the above-mentioned abject, according to a preferred embodiment of the present invention, a cable end connector comprises a dielectric housing, a terminal received in the housing, a unitarily formed shell, and a cover attached to the shell for holding a coaxial cable therein.

The housing includes a base portion and a tubular portion engaged with the base portion. The base portion defines three cutouts, and the tubular portion forms three enlarged mounting legs fitted in the cutouts. The tubular portion axially defines a passageway therethrough. The terminal has a mating portion and a tail portion substantially perpendicularly to each other. The mating portion extends into the passageway for electrically meeting with a mating connector. The tail portion is retained on the base portion for connecting with an inner conductor of the coaxial cable. The shell includes a planar portion supporting the housing, and a trunk portion connected to the planar portion and interferentially fitting with the enlarged mounting legs of tubular portion of the housing, thereby tightly connecting the shell with the housing. A pair of converging free portions formed in a upper portion of the trunk portion and a pair of arms rearwardly extending from a lower portion of the trunk portion. A sealing tab extends rearwardly from a distal end of each arm and a shoulder formed on each arm and tab. The cover positions on the shoulders with the cover interferes against the free portions to keep the free portions from diverging with each other.

Other objects, advantages and novel feather of the invention will become more apparent from the following detailed description when taken in conjunction with the accompanying drawings.

BRIEF DESCRIPTION OF THE DRAWINGS

FIG. 2 is a perspective view of the cable end connector assembly with

DETAILED DESCRIPTION OF THE INVENTION

Figure 1:
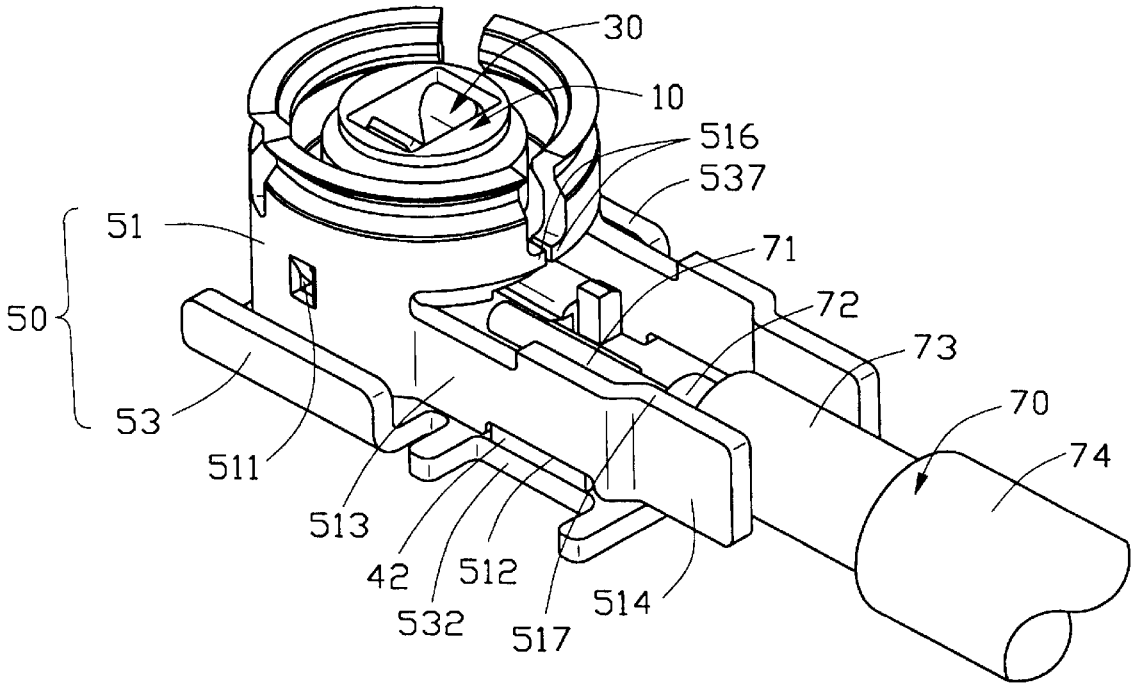
FIG. 1 is a perspective view of a cable end connector assembly according to the present invention without a cover.
Figure 2:
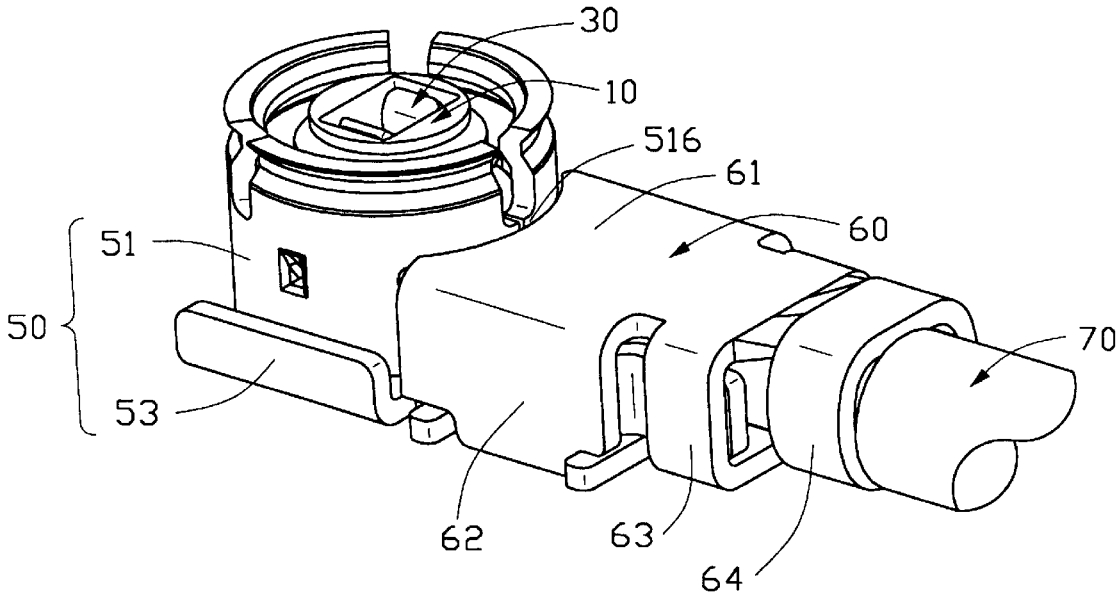

Referring to the drawings and particularly to FIGS. 1 and 2, a cable end connector in accordance with the present invention comprises a dielectric housing 10, terminal 30 received in the housing 10, a metallic shell 50 enclosing the housing 10, and a cover 60 for securing to an end portion of a coaxial cable 70. The same configuration of the housing 10, the terminal 30, the cover 60, and the cable 70 has been disclosed in previously mentioned copending application which is incorporated herein by reference. The shell 50 is described below with reference to FIG. 6.

Figure 6:
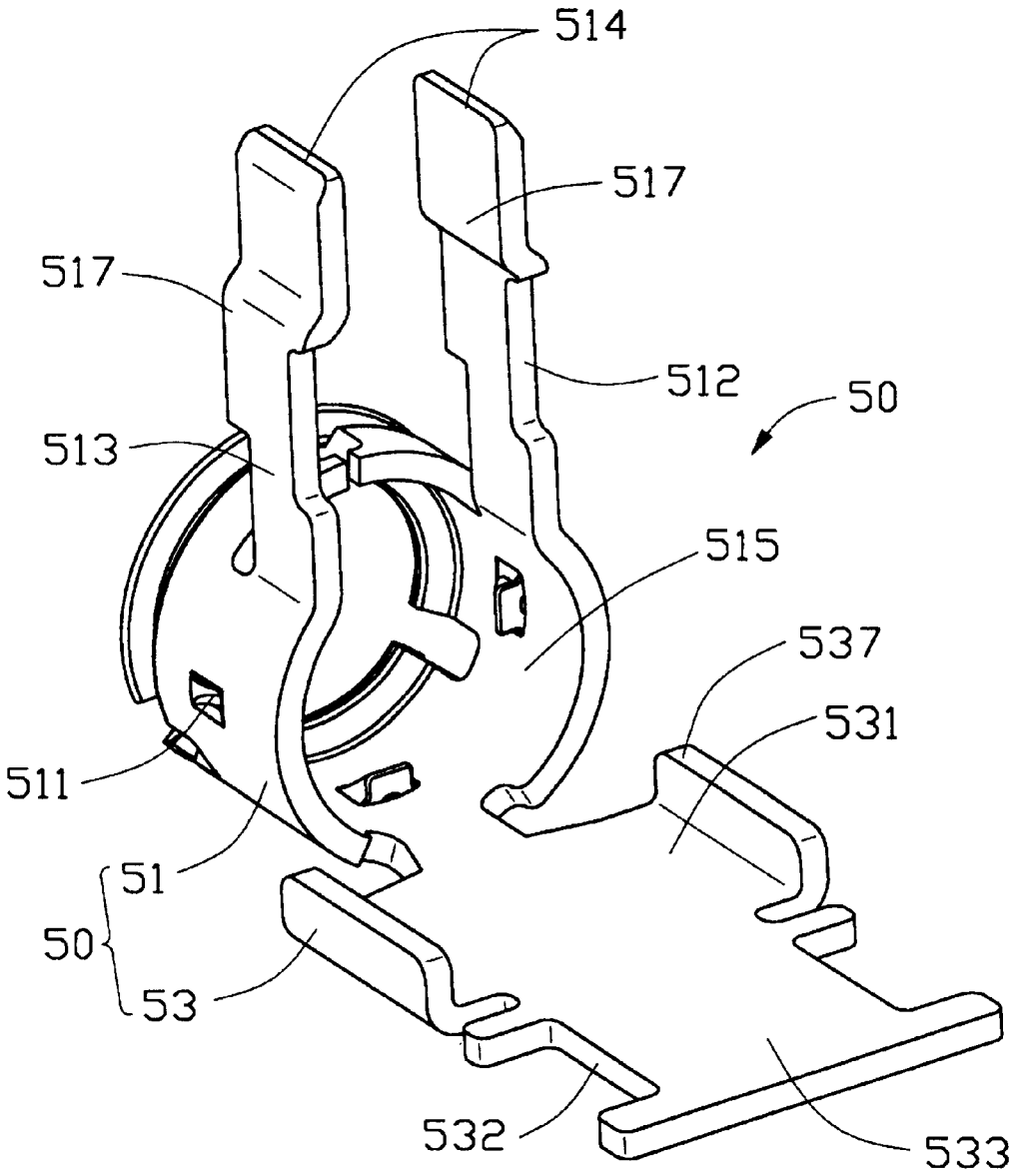
FIG. 6 is a perspective view of a shell of the cable end connector the shell is unbent.
Figure 7:
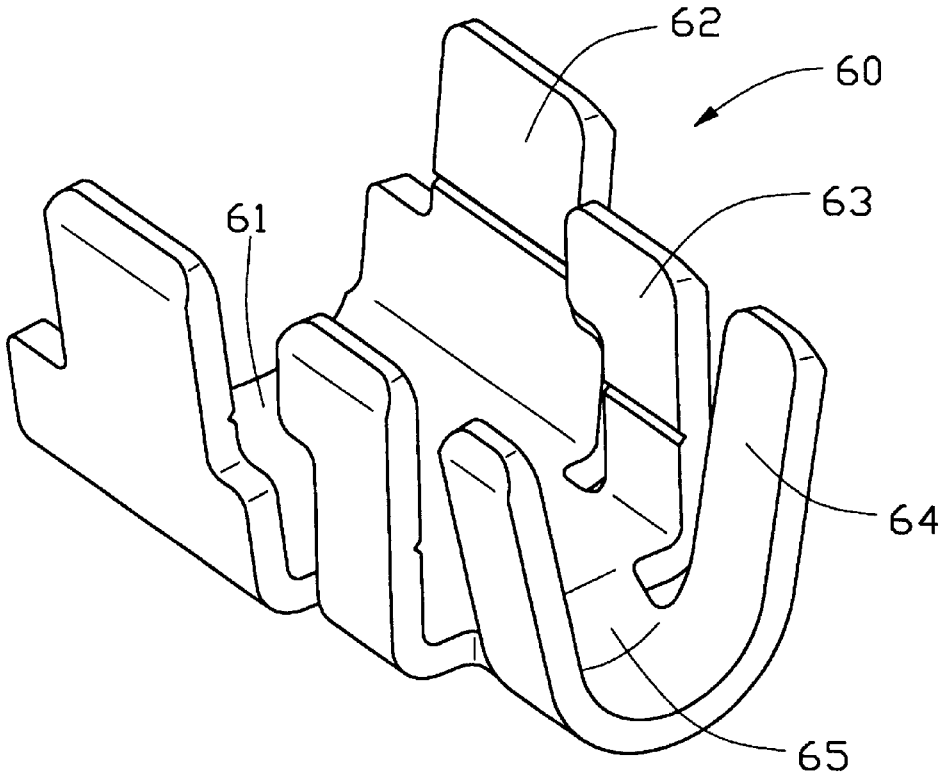
FIG. 7 is a perspective view of a cover of the cable end connector.
Figure 8:
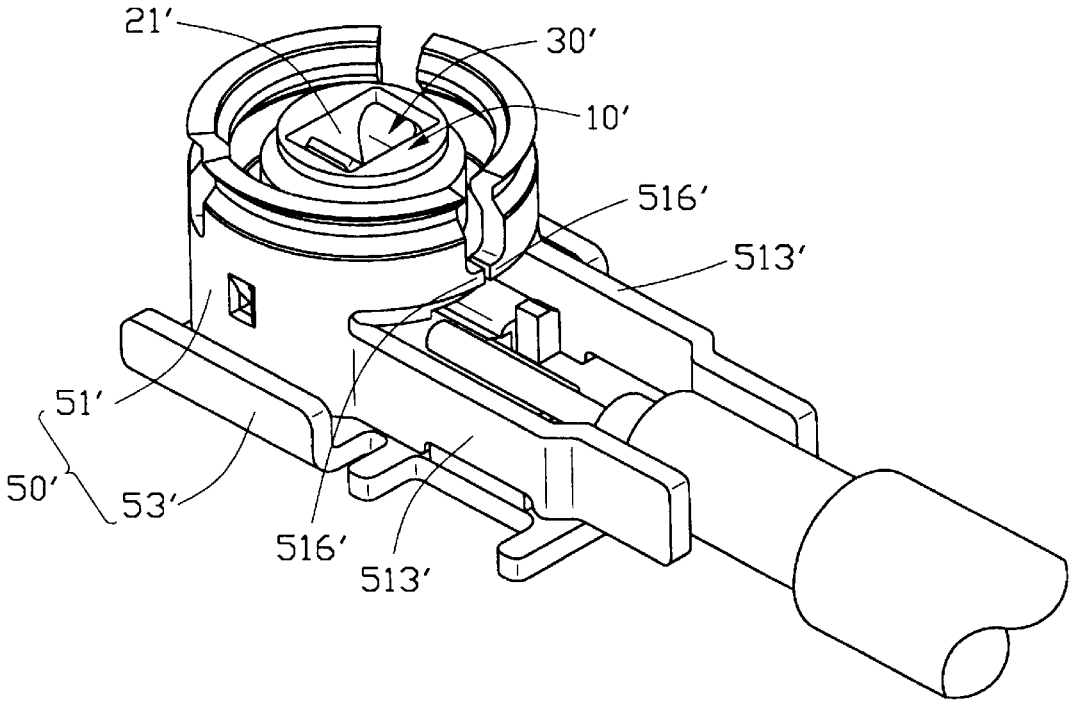
FIG. 8 is a perspective view of a cable end connector assembly without upon which the present invention is to improve.
Figure 9:
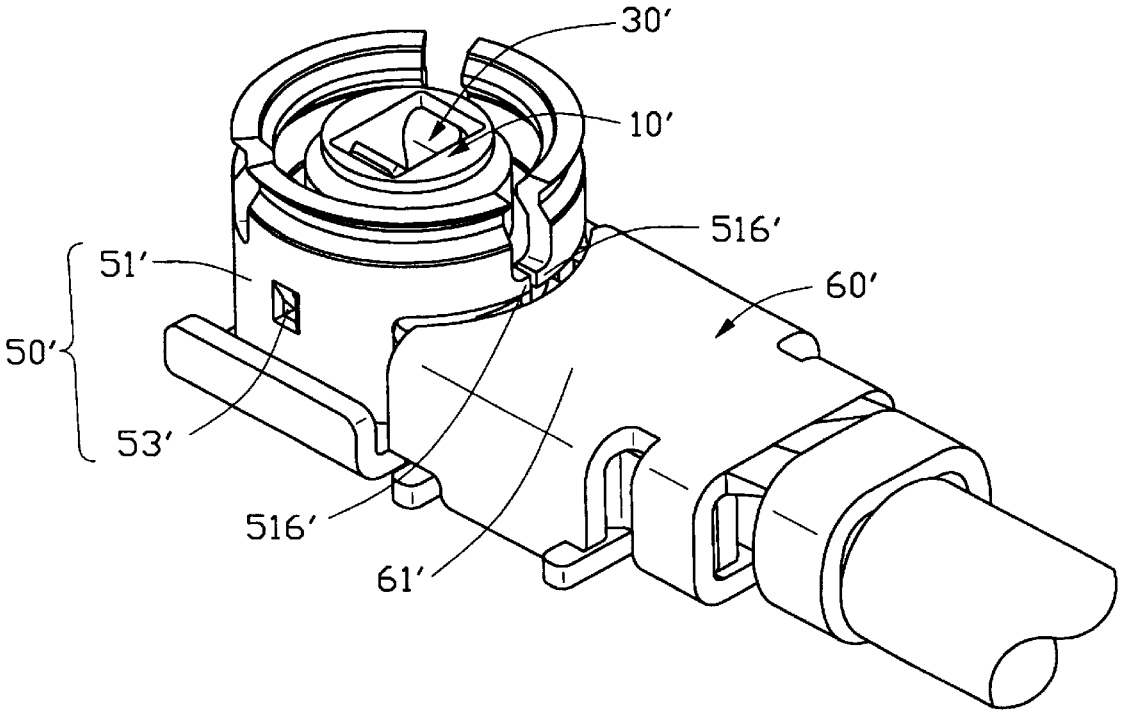
FIG. 9 is a perspective view of the cable end connector assembly of FIG. 8 with a cover.

Referring to FIG. 6, the shell 50 is unitarily formed and comprises a cylindrical trunk portion 51 and a planar portion 53 connected to the trunk potion 51. The trunk portion 51 has a pair of converging free portions 516 in a upper portion thereof and a pair of arms 513 rearwardly extending from a lower portion thereof. Each arm 513 defines a notch 512 in a lower end portion thereof. A sealing tab 514 extends rearwardly from a distal end of each arm 513 and shrinks inwardly slightly. A shoulder 517 formed on each arm 513 and tab 514 has a determined distance to the corresponding free portion 516. The trunk portion 51 defines a hollow portion 515 therethrough for enclosing the tubular portion 20 of the housing 10. Three hooks 511 are formed on an inner periphery of the trunk portion 51, e.g. at 90 degrees interval.

The planar portion 53 has a front portion 531 for supporting the trunk portion 51, and a rear portion 533 rearwardly extending from the front portion 531 for supporting the arms 513 and the housing 10. The front portion 531 forms a pair of side walls 537 in opposite sides thereof for fitting with the outer periphery of the trunk portion 51. The rear portion 533 defines a pair of elongated indentations 532 in opposite sides thereof.

Figure 3:
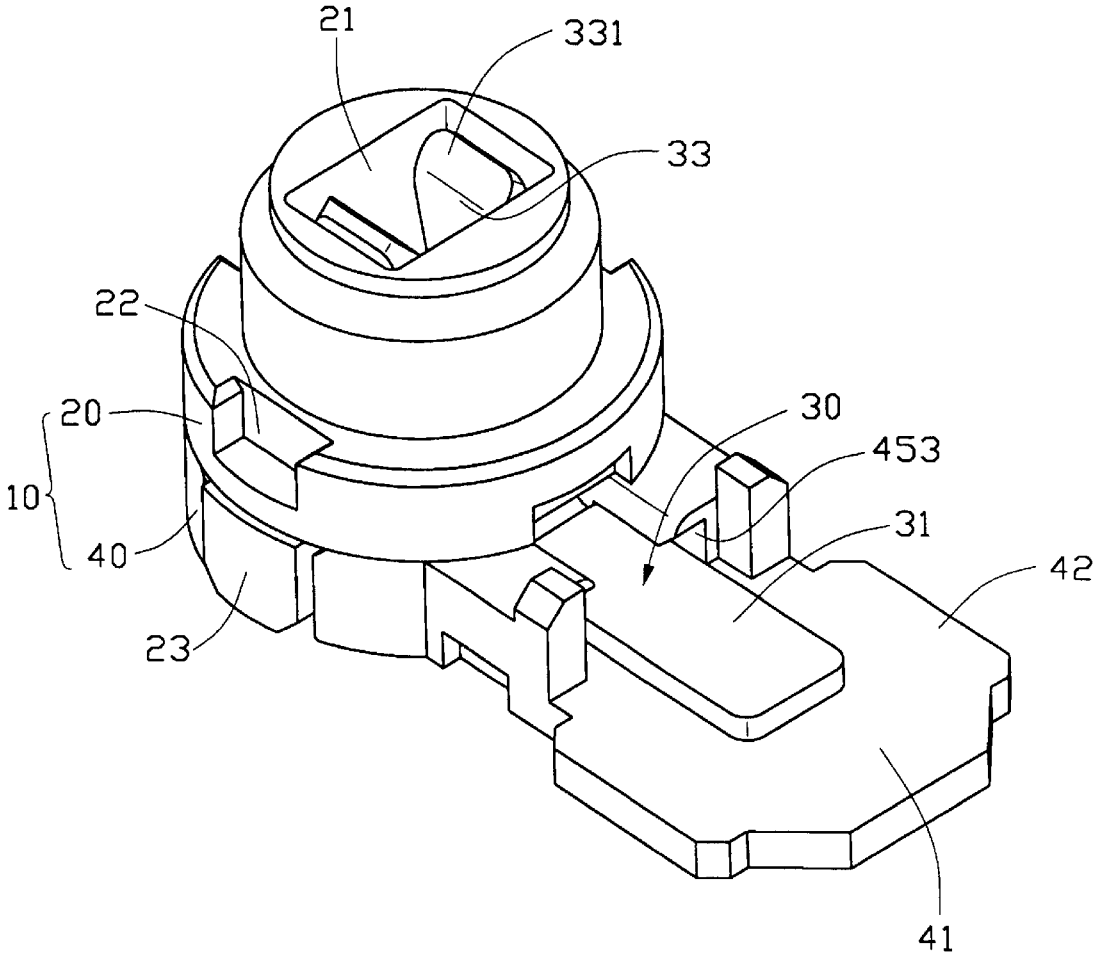
FIG. 3 is a perspective view of a housing and a terminal of a cable end connector according to the present invention.
Figure 4:
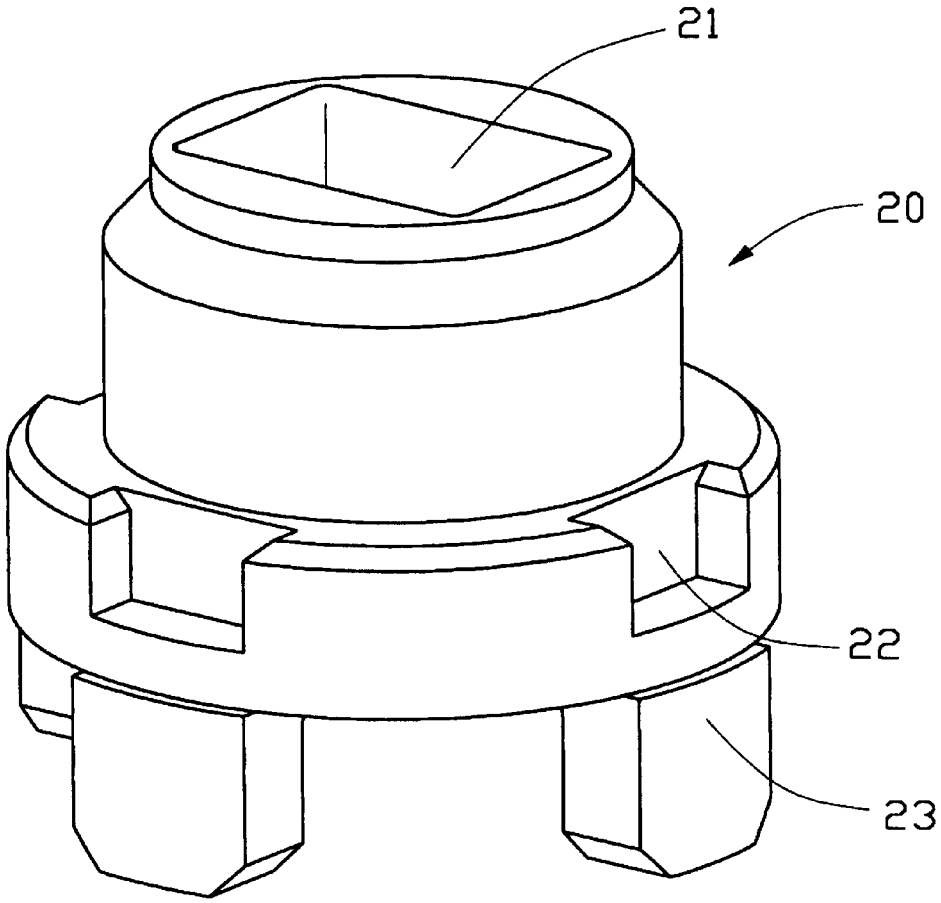
FIG. 4 is a perspective view of a tubular portion of the housing.
Figure 5:
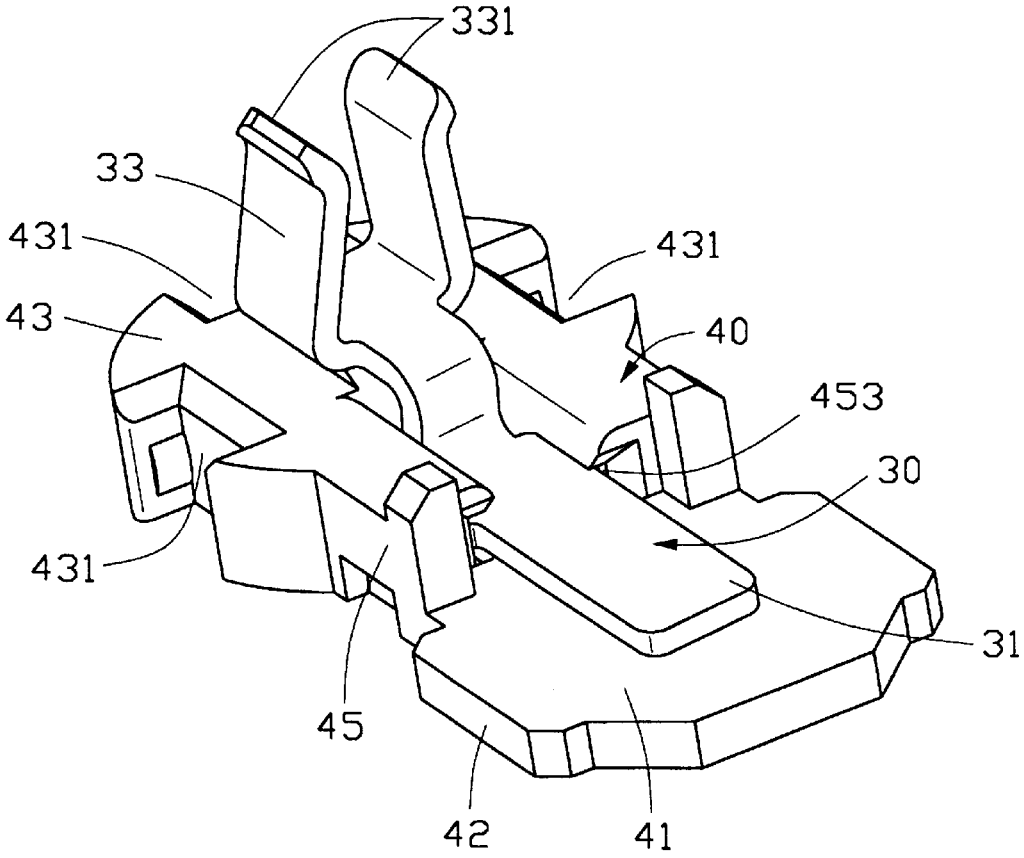
FIG. 5 is a perspective view of a base portion of the housing with the terminal.

Referring to FIGS. 1, 2 and 3, a cable end connector assembly is assembled as follows:

(1) The terminal 30 is inserted forwardly from a rear end of the base portion 40 of the housing 10. The tail portion 31 of the terminal 30 is partially retained in the grooves 453 and partially disposed on the flat portion 41 of the base portion 40.

(2) The tubular portion 20 of the housing 10 is mounted onto the base portion 40. The mating portion 33 of the terminal 30 extends into the passageway 21 of the tubular portion 20, the beams 331 of the mating portion 33 abutting against corresponding inner walls (not labeled) of the passageway 21.

(3) The inner conductor 71 of the coaxial cable 70 is soldered onto the tail portion 31 of the terminal 30.

(4) The trunk portion 51 of the shell 50 is brought to encircle the housing 10. The hooks 511 of the trunk 51 interferentially engage with the recesses 22. The inner periphery of the trunk portion 51 tightly engages with the enlarged mounting legs 23 of the tubular portion 20. The arms 513 accommodate the flat portion 41 of the housing 10 therebetween with the notch 512 thereof engaging with the positioning wing 42.

(5) The planar portion 53 is bent toward the trunk portion 51 until the planar portion 53 completely abuts a bottom of the housing 10 with the side walls 537 of the planar portion 53 fitting with the outer periphery of the trunk portion 51.

(6) The cover 60 parks on the shoulders 517 of the trunk portion 51 of the shell 50. The body portion 61 of the cover 60 interferes against the free portions 516 of the trunk portion 51 of the shell 50. Each of the locking tabs 62 of the cover 60 engages with a corresponding indentation 532 of the planar portion 53 and is bent, thereby fixedly retaining the arms 513 to an upper face of the planar portion 53. The tail portion 31 of the terminal 30 is therefore surrounded by both the arms 513 and the body portion 61 of the cover 60 but without contacting either. The braiding crimp 63 of the cover 60 encloses a part of the sealing tabs 514 of the trunk portion 51 for securely clamping the braiding layer 73 of the coaxial cable 70. The outer insulator 74 of the coaxial cable 70 is firmly retained in the strain relief 64 of the cover 60. The offset portion 65 is slantwise disposed between the braiding crimp 63 and the strain relief 64.

Since the body portion 61 of the cover 60 interferes against the free portions 516 of the trunk portion 51 of the shell 50, when a mating connector mates/unmates with the cable end connector, the body portion 61 will press the free portions 516 to keep the free portions 516 from diverging with each other, so the cable end connector is reliable to mate/unmate with the mating connector. In addition, the mating force or the unmating force is uniform to distribute around the round shape of the trunk portion 51 of the shell 50. Thus, the cable end connector provides a reliable connection with a mating connector.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. A cable end connector for electrically connecting with a cable, comprising:

a housing including a base portion defining cutouts in an outer periphery thereof, and a tubular portion having enlarged mounting legs fitted in said cutouts;

a terminal received in the housing;

a metallic shell including a trunk portion and a planar portion connected to the trunk portion, the trunk portion having a pair of converging free portions in an upper portion thereof and a pair of arms rearwardly extending from a lower portion thereof, a shoulder being formed on each arm and spaced a predetermined distance from the corresponding free portion, the trunk portion interferentially fitting the enlarged mounting legs of the tubular portion of the housing; and a cover attached to the shoulders to hold a coaxial cable therein and interfering against the free portions of the trunk portion;

wherein the tubular portion of the housing has recesses in an outer periphery thereof, and the trunk portion of the shell has hooks on an inner periphery thereof for engaging with said recesses, respectively;

wherein the base portion of the housing includes an engaging block and a flat portion extending rearwardly from the engaging block, the flat portion including a pair of the positioning wings projecting laterally from opposite sides thereof, and wherein each arm of the trunk portion defines a notch for receiving a corresponding positioning wing;

wherein the planar portion of the shell defines a pair of elongated indentations in opposite sides thereof, and the cover forms a pair of locking tabs fitted in the indentations respectively;

wherein the planar portion of the shell is bent to support the trunk portion;

wherein the base portion defines a pair of grooves in opposite lower corners thereof, and wherein the terminal forms a tail portion partially retained in the grooves.

* * * * *